United States Patent [19]

Applegate et al.

[11] Patent Number: 4,558,963

[45] Date of Patent: Dec. 17, 1985

[54] FEED RATES AND TWO-MODE EMBODIMENTS FOR THERMAL TRANSFER MEDIUM CONSERVATION

[75] Inventors: Steven L. Applegate; James J. Molloy, both of Lexington, Ky.; Clayton V. Wilbur, San Jose, Calif.

[73] Assignee: International Business Machines Corporation, Armonk, N.Y.

[21] Appl. No.: 640,208

[22] Filed: Aug. 10, 1984

Related U.S. Application Data

[63] Continuation of Ser. No. 413,272, Aug. 30, 1982, abandoned.

[51] Int. Cl.[4] ..... B41J 3/20

[52] U.S. Cl. ..... 400/120; 400/225; 400/227; 400/229; 400/232; 400/235.1

[58] Field of Search ..... 400/120, 213, 213.1, 400/225, 227, 227.2, 229, 232, 233, 235.1, 236, 507, 696, 697.1

[56] References Cited

U.S. PATENT DOCUMENTS

| | | | |
|---|---|---|---|
| 1,934,897 | 11/1933 | Watson | 400/507 |
| 3,051,132 | 8/1962 | Johmann | 401/101 |
| 3,079,604 | 2/1963 | Schwarzer | 346/136 |
| 3,232,229 | 2/1966 | Anderson | 400/213 X |
| 3,346,090 | 10/1967 | Goff, Jr. et al. | 400/213.1 X |
| 3,528,536 | 9/1970 | Caudill et al. | 400/213.1 |
| 3,604,549 | 9/1971 | Caudill et al. | 400/213.1 X |
| 3,744,611 | 7/1973 | Montanari et al. | 400/120 |
| 3,855,448 | 12/1974 | Hanagata et al. | 400/120 X |
| 3,985,216 | 10/1976 | McIntosh | 400/120 |
| 4,103,066 | 7/1978 | Brooks et al. | 400/120 X |
| 4,132,486 | 1/1979 | Kwan | 400/213 |
| 4,231,667 | 11/1980 | Behrendt et al. | 400/227.2 X |
| 4,232,976 | 11/1980 | Bernardis et al. | 400/235.1 X |
| 4,280,767 | 7/1981 | Heath | 400/216.2 |
| 4,308,318 | 12/1981 | Weiche | 400/120 X |
| 4,329,071 | 5/1982 | Applegate et al. | 400/120 |
| 4,329,075 | 5/1982 | Applegate et al. | 400/120 X |
| 4,353,658 | 10/1982 | Craft | 400/232 |
| 4,384,797 | 5/1983 | Anderson et al. | 400/120 X |
| 4,396,308 | 8/1983 | Applegate et al. | 400/120 X |
| 4,408,908 | 10/1983 | Applegate et al. | 400/120 |
| 4,456,392 | 6/1984 | Nozaki et al. | 400/120 |
| 4,491,853 | 1/1985 | Hayashi | 346/76 PH |

FOREIGN PATENT DOCUMENTS

| | | | |
|---|---|---|---|
| 0102474 | 3/1984 | European Pat. Off. | 400/232 |
| 2821135 | 11/1979 | Fed. Rep. of Germany . | |
| 3125501 | 4/1982 | Fed. Rep. of Germany . | |
| 3145221 | 6/1982 | Fed. Rep. of Germany . | |
| 2494186 | 5/1982 | France . | |
| 0062183 | 5/1981 | Japan | 400/120 |
| 0062184 | 5/1981 | Japan | 400/120 |

OTHER PUBLICATIONS

IBM Technical Disclosure Bulletin, "Ribbon Feed Interrupt Technique for One-Way Clutch Ribbon Feed Mechanism", Haus, vol. 21, No. 6, Nov. 1978, pp. 2195-2196.

*IBM Technical Disclosure Bulletin,* vol. 19, No. 4, Sep. 1976, by D. P. Darwin, "Ribbon Drive", pp. 1407-1408.

*IBM Technical Disclosure Bulletin,* by M. D. Sweet et al., entitled "Reduced Consumption of Ribbon on an Impact Printer," vol. 23, No. 8, Jan. 1981, at p. 3506.

*Primary Examiner*—Ernest T. Wright, Jr.

*Attorney, Agent, or Firm*—John A. Brady

[57] ABSTRACT

Conservation of ribbon 40 is achieved by underfeeding ribbon 40 relative to movement of thermal printhead 16. Pressure of printhead 16 may be low enough that smearing from a typical ribbon 40 does not occur. Gears 208, 210, 212, 214 and 216 may be positioned in one of two settings by action of bellcrank 230. One position provides a 1.04 to 1 underfeed ratio and the other provides a 5 to 1 underfeed ratio. Control 232 lowers print current for the 5 to 1 ratio. A printer having a single ratio of 1.04 to 1 provides printing of unimpaired quality with significant saving of ribbon.

90 Claims, 4 Drawing Figures

FIG. 1 PRIOR ART
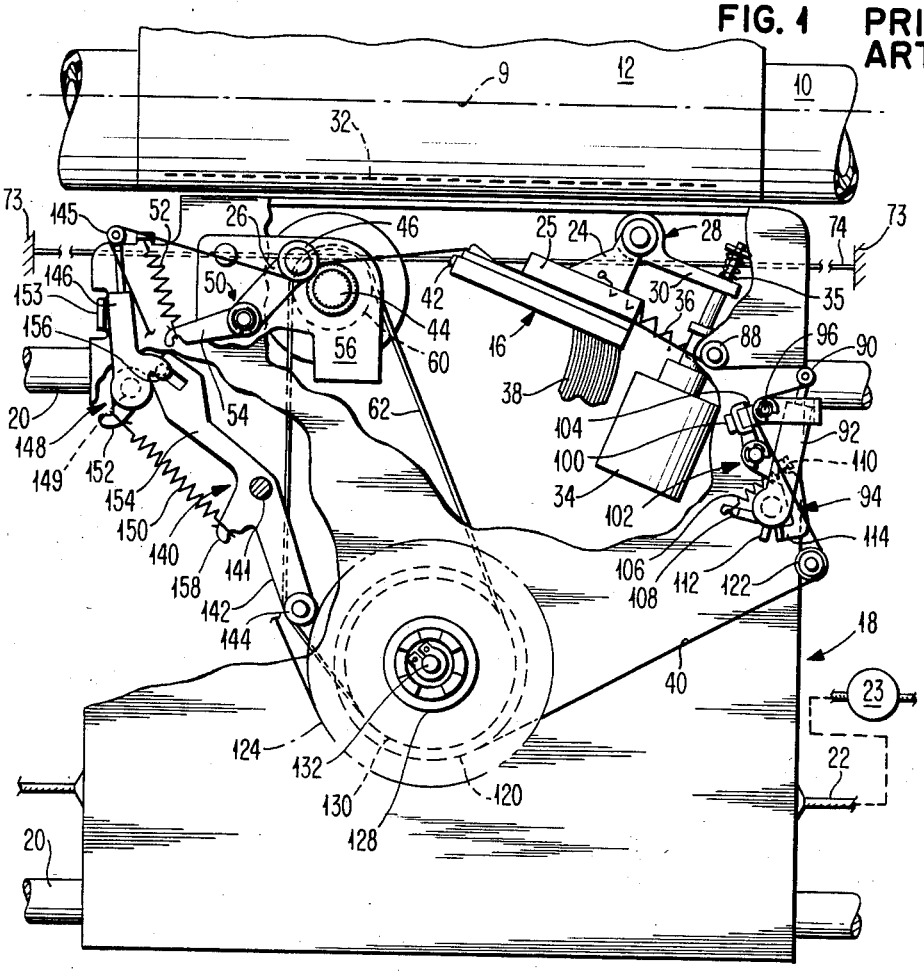
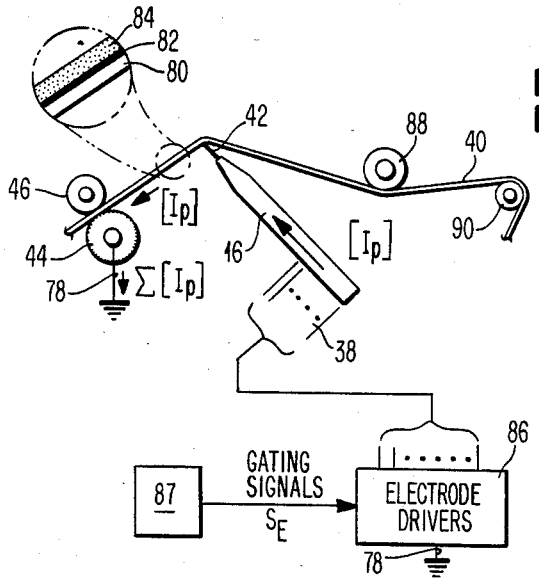
FIG. 2 PRIOR ART

FEED RATES AND TWO-MODE EMBODIMENTS FOR THERMAL TRANSFER MEDIUM CONSERVATION

Description

This application is a continuation of application Ser. No. 413,272 filed Aug. 30, 1982, now abandoned.

TECHNICAL FIELD

This invention relates to printers employing a thermal transfer medium from which marking material is transferred when it is softened by heat to a flowable state. Such transfer mediums are often ribbons having an electrically resistive substrate, while the printers have a printhead having a group of electrodes which are selectively driven to provide current in the resistive layer. Heat generated by this current softens marking material carried by the substrate to cause it to flow onto paper or another medium being printed upon. Alternatively, the printhead may generate heat by a mechanism independent of the characteristics of the transfer medium, with the substrate of the transfer medium adapted to transmit the heat to marking material carried by the substrate.

In all such printers the transfer medium is fed past the printhead to bring unused marking material to the printhead. Ribbon feed is accomplished by mechanical structures which typically pull a ribbon from a supply roll while winding used ribbon onto a takeup roll.

BACKGROUND ART

This invention employs feeding at a rate slower than printing to effect conservation or saving of the transfer medium. It is believed that prior to this invention thermal transfer mediums have been universally assumed to be useful only for a single printing of a character from a ribbon area substantially identical in size to the character printed. Any significant underfeed would have been avoided as it would be expected to produce incomplete printing and possibly smearing across the width of the printhead. Accordingly, ribbon underfeed would have been avoided, especially substantial underfeed which would provide significant conservation of the ribbon.

Certain types of ribbon are commonly recognized as adapted to be overstruck during use. These are typically liquid-ink saturated fabric elements or resinous matrix elements holding liquid ink in the manner of a sponge. Ribbon feed mechanisms for such ribbon often underfeed. U.S. Pat. No. 3,528,536 to Caudill et al and 3,232,229 to Anderson are illustrative teachings of ribbon underfeed for impact printers. U.S. Pat. No. 4,132,486 to Kwan teaches a ribbon feed pattern to effect ribbon conservation, but the pattern does not involve underfeed and the printer is an impact printer. IBM Technical Disclosure Bulletin article entitled "Ribbon Drive," by D. P. Darwin, Vol. 19, No. 4, September 1976 at pp. 1407–1408 teaches thermal printing with advancing only during printing to conserve ribbon. The ribbon advance during printing is expressly said to be the same velocity as the printhead.

DISCLOSURE OF THE INVENTION

In accordance with this invention the transfer medium of a thermal printer is fed at a rate significantly less than the rate of printhead movement. This underfeeding directly conserves ribbon since less is used. Print currents generally are reduced from those of nonunderfeed printing of the same ribbon as the dwell of the ribbon under the printhead is increased. As there is rubbing movement of the ribbon across the paper being printed upon during underfeed, printhead pressure toward the paper can be minimized for those ribbons which have a tendency to smear. With these exceptions the other printing structures and mechanisms may be those previously existing and the transfer medium may be one previously developed for printing without underfeed, including one with a resistive layer as a supporting substrate for the marking material.

Such existing ribbons have been examined at nominal printhead-to-ribbon-feed ratios of 1.02 to 1 to 20 to 1. In the particular system employed, the long exposure to heat inherent in ratios above 20 to 1 caused the ribbon to burn, thus not permitting operation at above 20 to 1. Although ribbons of some materials appear to function better than others in the printing system employed, all typical ribbons functioned adequately when printhead pressure was kept low. In fact, no ribbon not functioning reasonably well during underfeed was observed, but it would be expected that a ribbon with an exceptionally soft marking layer would smear onto the paper even from the minimum pressure required of a thermal printhead. Similarly, it would be expected that a ribbon with an exeptionally thin layer of marking material would become exhausted of material and have at best very dim printing, at least at high ratios.

The amount of ribbon saved is at least the difference between that which would be fed at 1 to 1 ratio and the amount actually fed. At ratios above a nominal 1.04 to 1, print quality diminishes. Both optical density and resolution decrease. These deficiencies increase as the feed ratio increases. Nevertheless print quality remains readable even up to the 20 to 1 ratio. Where highest quality printing is the ultimate objective, the feed mechanism can be switched between a draft mode and a final-copy mode, as is done in some prior impact printing systems. The final-copy mode in accordance with this invention preferably will be substantially 1.04 to 1, as print degradation is negligible at that ratio while ribbon conservation at 1.04 to 1 is significant.

The specific embodiment disclosed employs a printhead having a line of electrodes disposed vertically. The printhead is moved longitudinally across paper being printed upon, a direction perpendicular to the line of electrodes. The electrodes move over areas corresponding to the size and location of symbols to be printed and the electrodes are driven to generate heat to print those symbols.

A two-mode embodiment is disclosed in which maximum quality printing is achieved in one mode by feeding the ribbon near the head velocity. Ribbon saving is achieved in the second mode, during which drafts may be prepared. Preferably the high-quality mode has an underfeed ratio of 1.04 to 1 while the draft mode has a ratio of 5 to 1. A minimum ratio to achieve significant savings compared to the high-quality mode may be arbitrarily considered to be at a 2 to 1 underfeed ratio.

BRIEF DESCRIPTION OF DRAWING

A detailed description of the best and preferred implementation is described in detail below with reference to the drawing, in which:

FIG. 1 shows a top view of a typical ribbon feeding mechanism of a general kind used in existing printing and therefore conveniently illustrative of ribbon feeding for this invention. Since ribbon-feed-ratio mechanism and print-current levels do not appear in FIG. 1, it is labeled "Prior Art".

FIG. 2 is a more detailed view of a part of FIG. 1 illustrating also the ribbon in some detail. Since ribbon-feed-ratio mechanisms and print-current levels do not appear in FIG. 2, it is labeled "Prior Art."

BEST MODE FOR CARRYING OUT THE INVENTION

Figure 3:
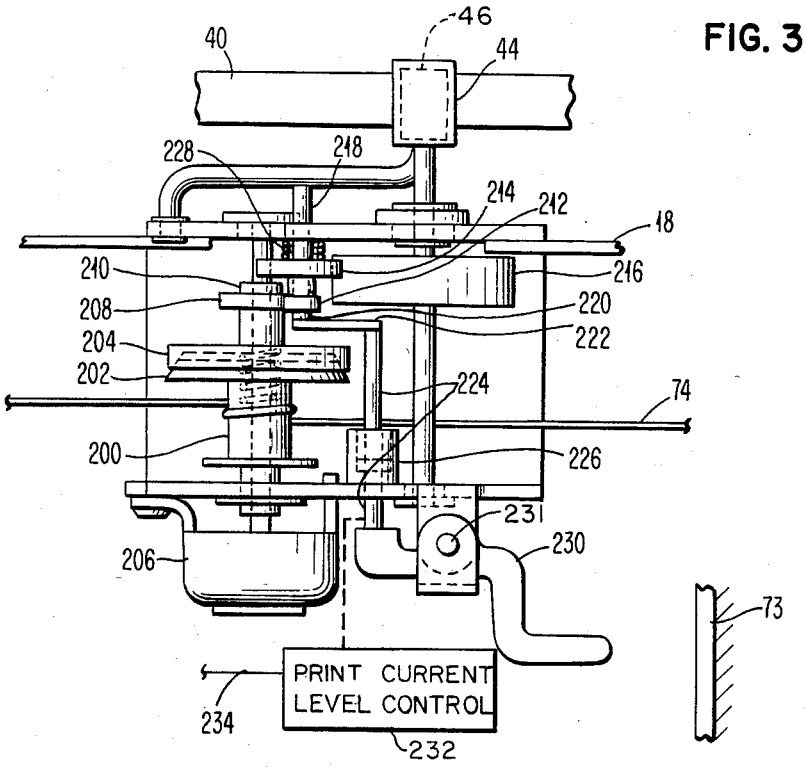
FIG. 3 is a side view of a drive mechanism to control the degree of ribbon feed achieved by the mechanism of FIG. 1.
Figure 4:
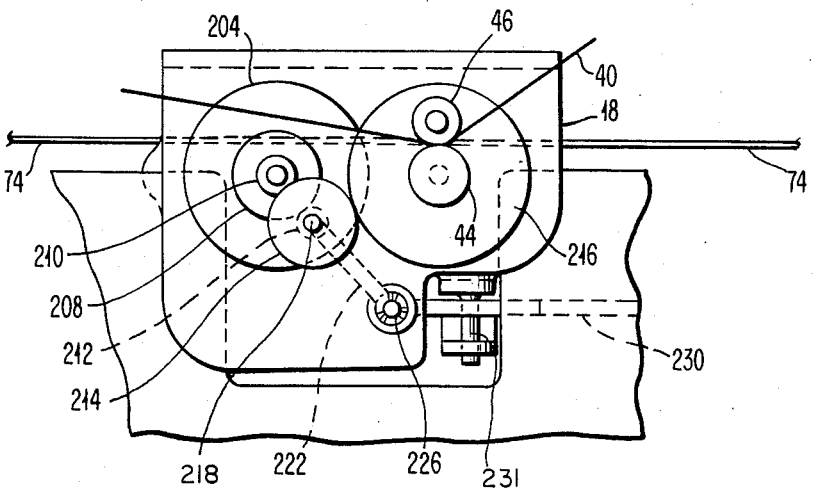
FIG. 4 is a top view showing major mechanical elements of the mechanism of FIG. 3.

This invention is not dependent upon any significant novelty of the feeding mechanism, and suitable feeding mechanisms of various kinds may be devised using the ordinary skills of the art. This invention is typically used with an existing printer, and feed mechanism essentially similar to that of the existing printer is considered preferred since that mechanism is both as suitable as any other and well understood. Such feed mechanism is described in detail in U.S. Pat. No. 4,408,908, patented Oct. 11, 1983, filed Dec. 12, 1980, by S. L. Applegate and J. J. Molloy entitled "System For A Matrix Printer."

Referring to FIG. 1, which illustrates the existing mechanism, the printer configuration includes an elongated, cylindrical platen 10 that is adapted to support a medium 12 such as a sheet of paper for receiving printing marks. To effect printing movements, a carrier 18 is mounted on guide rails 20 for movement parallel to the longitudinal axis 9 of the platen 10. Drive motion is coupled to the carrier 18 by a cable 22 connected to a drive system 23 (shown illustratively) as is well known in the art.

The printhead 16 is mounted at a mounting plate 25 on one arm 24 of a pivot member 28 which is pivotally mounted on the carrier 18. Movement of the printhead 16 from a retracted position (shown) to an operative position at the print line 32 is effected by a solenoid 34 that is connected through spring 35 to a second arm 30 of the pivot member 28. Spring 35 limits the force of printhead 16 against platen 10. A spring 36 serves to return the printhead 16 to the retracted position when the solenoid 34 is deenergized.

As will be discussed more fully below, the printhead 16 is of the type adapted to receive printing signals at a set of signal channels 38 and supply such signals to a printing ribbon 40 by means of respective electrodes 42 that are arranged in a line array.

Metering of the printing ribbon 40 is effected by cooperating metering rollers 44 and 46 located on the carrier 18 on the takeup side of the printhead 16 on the feed path of the printing ribbon 40.

Roller 44 is preferably arranged on the side of the ribbon 40 that faces the printhead 16 and is mounted at a fixed position on the carrier 18. Firm pressure contact with the ribbon 40 is achieved by mounting the roller 46 on an arm 26 of a pivoting member 50 and providing ribbon nipping force by means of a spring 52 acting on a second arm 54. For assembly convenience, both the roller 44 and the pivoting member 50 are mounted on a support bracket 56 that is fixedly mounted on the carrier 18. Drive power to rotate roller 44 is selectively applied by linking cable 74 to roller 44. Cable 74 is attached to the printer frame 73 (indicated symbolically).

Controlled printing currents (Ip) for the presently preferred implementation (see FIG. 2) are supplied to the ribbon 40 which includes an outer moderately resistive layer 80, an intermediate conducting aluminum layer 82 and an ink transfer layer 84. The currents Ip are collected by the roller 44 by contact with the moderately resistive layer 80. To improve the quality of connection still further, the roller 46 may also be used to establish a connection to the ribbon 40. For example, the aluminum layer 82 may be engaged at voids in the ink transfer layer 84 left by printing as described in U.S. Pat. No. 4,329,071 to S. L. Applegate and S. Dyer, filed June 30, 1980, and issued May 11, 1982. The printing currents (Ip) are supplied from a set of electrode drivers 86 which selectively control the occurrences of current applied to the respective electrodes 42 in accordance with gating signals $S_E$ from a printer controller 87 as is well known in the art. The currents Ip return to the electrode driver 86 through one or both of metering rollers 44 and 46 along a path 78 that may be a distinct conductor or may include metal portions of the printer.

Referring again to FIG. 1, a surface 96 is mounted on the supply side of the feed path for the printing ribbon 40. The surface 96 directs the ribbon 40 at one end of a tension loop and also serves to provide a clamping surface for brake action by a brake arm 100 of a pivot member 102. For the braking position shown, the ribbon 40 is clamped between a pad 104 mounted on the brake arm 100 and the surface 96.

Biasing force is applied to pivot members 94 and 102 by a spring 106 that is stretched between tab arms 108 and 110. As a result of the angular positions of tab arms 108 and 110 on pivot members 94 and 102, respectively, the biasing force urges arm 92 carrying roller 90 around which ribbon 40 is looped to increase the size of the loop of the ribbon 40 between roller 88 and surface 96. Also, the biasing force tends to drive the brake arm 100 to a position for clamping the ribbon 40. Release of the clamping action on the ribbon 40 is effected by a brake drive arm 112 of pivot member 94 that engages and coacts with a brake release arm 114 of pivot member 102.

Supply reel 120 and a takeup reel 124 are in concentric arrangement. Ribbon 40 is initially directed around roll 122. The supply reel 120 is free to rotate leaving control of tension on the supply side of the metering rollers 44 and 46 to the cooperating pivot members 94 and 102. A hub 128 receives the takeup reel 124 and is keyed to it to prevent relative rotation. Motion for rotating the takeup reel 124 is transmitted by the drive belt 62 to a pulley 130 which is connected by a shaft 132 to the hub 128. Substantially uniform ribbon tension on the takeup side of the metering rollers 44 and 46 is achieved by the action of a pivot member 140, pivoted on shaft 141, that includes a coupling control arm 142 on which a belt tensioning roller 144 is mounted. Tension in the ribbon 40 is sensed by guide 145 on arm 146 of a pivot member 148, pivoted on shaft 149, which is rotated against the bias of a stretched spring 150 acting on an arm 152 and arm 158 of member 140. While takeup exceeds the metering rate, the arm 146 is pulled away from a stop tab 153 and toward the metering rollers 44 and 46 by the ribbon 40. This motion is transmitted to an arm 154 of the pivot member 140 by a linkage arm 156 of the pivot member 148. As the ribbon 40 draws the arm 146 away from the stop tab 153, the above-described linkage arrangement causes the roller 144 to move toward the center of the path of the belt 62 reducing belt tension and eventually decoupling the pulleys 60 and 130 so as to eliminate ribbon 40 takeup. As ribbon 40 again builds up on the takeup side of metering rollers 44 and 46, the stretched spring 150 is able to act on arm 152 and on arm 158 of pivot member 140 to force movement of the roller 144 to tighten the belt 62.

With such tension control, uniform tight wrapping of the takeup reel 124 is achieved.

RIBBON DESCRIPTION

Ribbon 40 is a three-layer laminate of regular cross-section. Resistive, bottom layer 80 (FIG. 2) is polycarbonate with conductive, particulate carbon black. The resistive layer 80 typically is 15 microns in thickness. The intermediate layer 82 is a 1000 angstroms thick layer of vacuum-deposited aluminum. Ink transfer layer 84 is on the aluminum layer 82 and is a 4 to 6 microns thick layer flowable in response to heat created by electric current applied from the outside of the resistive layer 80.

The fabrication and specific form of the resistive substrate or layer 80 forms no essential part of this invention. A representative teaching of the fabrication of a polycarbonate substrate for this purpose is disclosed in U.S. Pat. No. 4,103,066 to Brooks et al. Three parts of a polycarbonate resin, typically such as Mobay Chemical Corporation Merlon, or Makrolon polycarbonate resin, is coated from a dispersion containing particulate conductive carbon (such as XC-72 from Cabot Corporation).

An ink layer 84 typical of those employed in developing this invention has a fatty acid polyamide as the main body component. Versamid 940, product of General Mills Chemicals, Inc. exhibited good compatibility with the polycarbonate and was preferred. (U.S. Pat. No. 4,308,318 to W. J. Weiche is directed generally to such use of fatty acid polyamides). In addition to the polyamide, ink layer 84 typically has a minor amount of carbon black as a pigment and a very small amount of violet dye as a supplementary coloring agent.

This invention is not dependent upon any novelty of the ribbon materials. At one point results apparently better than those from a polyamide ink layer where realized using an ink layer having polyketone instead of polyamide. Both types of ribbons functioned well in accordance with this invention and no basis is known restricting a future ribbon to either of such materials. No resin is known which is considered essentially preferable for use as the marking material body for this invention.

Although no ribbon not capable of functioning in accordance with this invention has been observed, as previously mentioned, it would be expected that a ribbon with an exceptionally soft marking layer would smear onto paper even from the light pressure of a thermal printhead. Similarly, it would be expected that a ribbon with an exceptionally thin layer of marking material would become exhausted of material and have at best very dim printing, at least when the extent of underfeed is large.

UNDERFEED ELEMENTS

FIG. 3 shows a side view of a system linked to roller 44 to achieve both substantial underfeed at one setting and 1.04 to 1 underfeed at a second setting. This is mounted on carrier 18. Cable 74 is wrapped around capstan 200. As carrier 18 moves during a printing operation, capstan 200 is rotated by cable 74 to provide power for ribbon feed. This power is transferred through clutch faces 202 and 204, when they are engaged by the actuation of a control, which may be solenoid 206 as shown.

Friction rollers or gears 208, 210, 212, 214 and 216 are arranged to allow selection of either a 1.04 to 1 ratio or a high ratio, typically 5 to 1, of the movement along cable 74 and the tangential movement of feed roller 44.

Selection is effected by varying the vertical position of the shaft 218 to which gears (or rollers) 212 and 214 are fixedly attached. Shaft 218 is free to rotate on an internal shaft 220, while it may be moved vertically under the influence of arm 222, to which shaft 220 is fixedly attached. Arm 222 is fixedly attached to shaft 224. Shaft 224 passes through locking cap 226, a mechanism functionally equivalent to that controlling retraction of the common, standard ball point pen (U.S. Pat. No. 3,051,132 to Johmann, issued Aug. 28, 1962, shows such a mechanism readily adaptable to provide the function of locking cap 226). Spring 228 biases shaft 218 and through shaft 218, biases shaft 224 downward.

Accordingly, shaft 224 and shaft 218 carrying gears 212 and 214 are held in one of the two stable vertical positions by cap 226. Bellcrank 230 is pivoted on shaft 231. Bellcrank 230 engages the bottom of shaft 224 and is positioned to encounter a part of frame 73 when carrier 18 is moved past the normal far right margin during printing.

Bellcrank 230 is rotated clockwise when it encounters frame 73 to thereby lift shaft 224 vertically. If shaft 224 is already in the upper position, cap 226 frees shaft 224, and gears 212 and 214 drop to their lower position. If shaft 224 was in the lower position, shaft 224 is held in the higher position by cap 226 and gears 212 and 214 are raised to the upper position.

It should be understood that the gear arrangement is essentially identical to the prior art in a single element impact typewriter to change feed rates for a matrix ribbon used with overstrike and a one-use ribbon used without overstrike. Moreover, the use of a mechanical system employing frame 73 is entirely optional. It provides an advantage which may be desired by allowing ribbon feed selection at the control of either a human or automatic-data-processing controller which has the capacity of spacing the machine along the print line. Clearly, movement of shaft 224 could be achieved in essentially the same way as clutch face 202 is moved employing a solenoid 206. Dimensioning of the parts to achieve the ratios desired is a matter of ordinary design.

Shown symbolically is an electrical print-current-level control 232, linked to shaft 224 and producing a control signal an output line 234. The line 234 signal will cause high print currents when shaft 224 is down, as the underfeed ratio in that status in 1.04 to 1, while causing low print currents when shaft 224 is up. This is, of course, merely illustrative of a mechanism to automatically respond to the ribbon feed ratio and to adjust the print current accordingly.

A printer in which this ribbon conservation invention is to be continually used in one mode would not have selectable gears as shown. Instead, the dimensions would be selected to give the desired feed ratio. One primary use of such a single-mode application is to employ a small ratio such that print quality is not at all impaired, while significant ribbon saving can be achieved. The preferred ratio for this purpose is 1.04 to 1 underfeed.

The ribbon feed mechanism described functions essentially by response to longitudinal movement of ribbon 40. To insure proper feed rate during even slight underfeed, increased braking force on pad 104 in the supply feed may be required. This, in turn, can result in tension on printhead 16 tending to rotate it away from the print area. The routing of ribbon 40 may be done in such a way that the increased ribbon tension does not urge the head away from the platen 10. Such a ribbon feed arrangement for this purpose is described in detail in U.S. Pat. No. 4,329,075, filed June 27, 1980, by S. L. Applegate and J. J. Molloy, issued May 11, 1982, and entitled "Printhead Assembly For Typewriters or the Like."

It will be apparent, of course, that the manner or mechanism to achieve underfeed is not an essential part of this invention. Designs can be readily devised in which the two feed ratios are achieved in a manner employing, for example, two separate power sources and therefore not involving a direct change in the mechanical advantages applied to the ribbon 40.

DISCUSSION

Observation of a ribbon 40 after use with this invention reveals an image of the symbols printed distorted only in the direction of ribbon feed. Thus an "A" printed would appear on the ribbon 40 in the normal height of that character, but with the slanted sides and the cross stroke squeezed. This establishes that ink is not drawn from surrounding areas not under an electrode 42, but is taken from the part of the ribbon 40 which is fed under the electrode 42. This indicates that this invention functions by printing only a part of the marking layer 84 initially and more of the ink subsequently from the same part of the ribbon 40.

Although, as indicated, existing transfer mediums do generally function adequately in accordance with this invention, this is not to suggest that optimum ribbon formulations and design would not improve overall functioning and results. The Applicants herein have not extended their work or knowledge substantially into such optimum formulation or ribbon design, as distinguished from using existing ribbons. Applicants have concluded that a somewhat thicker ink layer or somewhat increased carbon black or both, can increase print quality when the underfeed is relatively great. But where the primary objective is the quality of the final copy, the ribbon 40 usually would be formulated for best quality at the ratio of that printing.

The increasing deterioration in print quality with increase in underfeed appears simply to be a function of diminished ink available at the zone of heat during printing.

Accordingly, patent coverage should not be limited by the specifics described, but should be as in accordance with the contributions here disclosed, with particular reference to the accompanying claims.

We claim:

1. A transfer-medium-conserving thermal printer comprising:

a printhead for providing a pattern of heat for thermal printing of images, means to move said printhead relative to a print-receiving location, and means to feed a transfer medium past said printhead for printing from said transfer medium from areas heated by said printhead, said means to move said printhead being for moving said printhead an amount which is in a ratio greater than about 5 to 1 with respect to the amount of feed by said means to feed a transfer medium to conserve a transfer medium being fed by feeding said transfer medium in an amount significantly less than the amount of printhead movement.

2. The thermal printer as in claim 1 in which said ratio is at least 5 to 1.

3. The thermal printer as in claim 2 in which said ratio is in the range of 5 to 1 to 20 to 1.

4. The thermal printer as in claim 3 in which said ratio is substantially 5 to 1.

5. The thermal printer as in claim 1 in which said printhead will provide electric current to a resistive layer of said transfer medium to provide said pattern of heat and said means to feed a transfer medium will feed a transfer medium having said resistive layer and a layer, separated from said printhead by said resistive layer, of marking material rendered flowable by said pattern of heat in a pattern defined by said pattern of heat.

6. The thermal printer as in claim 2 in which said printhead will provide electric current to a resistive layer of said transfer medium to provide said pattern of heat and said means to feed a transfer medium will feed a transfer medium having said resistive layer and a layer, separated from said printhead by said resistive layer, of marking material rendered flowable by said pattern of heat in a pattern defined by said pattern of heat.

7. The thermal printer as in claim 3 in which said printhead will provide electric current to a resistive layer of said transfer medium to provide said pattern of heat and said means to feed a transfer medium will feed a transfer medium having said resistive layer and a layer, separated from said printhead by said resistive layer, of marking material rendered flowable by said pattern of heat in a pattern defined by said pattern of heat.

8. The thermal printer as in claim 4 in which said printhead will provide electric current to a resistive layer of said transfer medium to provide said pattern of heat and said means to feed a transfer medium will feed a transfer medium having said resistive layer and a layer separated from said printhead by said resistive layer of marking material rendered flowable by said pattern of heat in a pattern defined by said pattern of heat.

9. A transfer-medium-conserving thermal printer comprising:

a printhead having a line of elements for providing heat for thermal printing, means to move said printhead longitudinally while printing images by heat provided by said elements to a transfer medium, said longitudinal movement being directed to move said line of elements over an area corresponding to symbols to be printed, and means to feed said transfer medium longitudinally past said printhead during said printing, said means to move said printhead being for moving said printhead an amount which is in a ratio greater than about 5 to 1 with respect to the amount of feed by said means to feed said transfer medium to conserve said transfer medium by feeding said transfer medium in an amount significantly less than the amount of printhead movement.

10. The thermal printer as in claim 9 in which said ratio is at least 5 to 1.

11. The thermal printer as in claim 10 in which said ratio is in the range of is 5 to 1 to 20 to 1.

12. The thermal printer as in claim 11 in which said ratio is substantially 5 to 1.

13. The thermal printer as in claim 9 in which said printhead will provide electric current to a resistive layer of said transfer medium to provide said heat and said means to feed said transfer medium will feed a transfer medium having said resistive layer and a layer, separated from said printhead by said resistive layer, of marking material rendered flowable by said heat.

14. The thermal printer as in claim 10 in which said printhead will provide electric current to a resistive layer of said transfer medium to provide said heat and said means to feed said transfer medium will feed a transfer medium having said resistive layer and a layer, separated from said printhead by said resistive layer, of marking material rendered flowable by said heat.

15. The thermal printer as in claim 11 in which said printhead will provide electric current to a resistive layer of said transfer medium to provide said heat and said means to feed said transfer medium will feed a transfer medium having said resistive layer and a layer, separated from said printhead by said resistive layer, of marking material rendered flowable by said heat.

16. The thermal printer as in claim 12 in which said printhead will provide electric current to a resistive layer of said transfer medium to provide said heat and said means to feed said transfer medium will feed a transfer medium having said resistive layer and a layer, separated from said printhead by said resistive layer, of marking material rendered flowable by said heat.

17. A transfer-medium-conserving thermal printer comprising:

a printhead for providing a pattern of heat for thermal printing of images, a transfer medium having a supporting substrate carrying a marking material flowable to print symbols in patterns defined by heat from said substrate, means to mount print-receiving medium adjacent said marking material, means to press said printhead into said transfer medium and said transfer medium into said print-receiving medium, means to move said printhead across said print-receiving medium during printing from said transfer medium with heat provided by said printhead, and means to feed unused transfer medium to said printhead during said printing at a velocity relative to the printhead about one-fifth of the velocity of movement of said printhead relative to the print-receiving medium to conserve said transfer medium by feeding said transfer medium at a velocity significantly less than the velocity of printhead movement, said means to press said marking material being selected so as not to smear on said print-receiving medium from rubbing on said print-receiving medium during said feeding of said transfer medium.

18. The thermal printer as in claim 17 in which said velocity of movement of said printhead is faster than said velocity of feed of said transfer medium by a ratio of at least 5 to 1.

19. The thermal printer as in claim 18 in which said ratio is in the range of 5 to 1 to 20 to 1.

20. The thermal printer as in claim 19 in which said ratio is substantially 5 to 1.

21. The thermal printer as in claim 17 comprising nip rolls to pull said transfer medium across said printhead as part of said means to feed unused transfer medium and in which said means to move said printhead comprises a carrier for moving across said print-receiving medium, and said printhead, said means to press, and said nip rolls are mounted on said carrier.

22. The thermal printer as in claim 18 comprising nip rolls to pull said transfer medium across said printhead as part of said means to feed unused transfer medium and in which said means to move said printhead comprises a carrier for moving across said print-receiving medium, and said printhead, said means to press, and said nip rolls are mounted on said carrier.

23. The thermal printer as in claim 19 comprising nip rolls to pull said transfer medium across said printhead as part of said means to feed unused transfer medium and in which said means to move said printhead comprises a carrier for moving across said print-receiving medium, and said printhead, said means to press, and said nip rolls are mounted on said carrier.

24. The thermal printer as in claim 20 comprising nip rolls to pull said transfer medium across said printhead as part of said means to feed unused transfer medium and in which said means to move said printhead comprises a carrier for moving across said print-receiving medium, and said printhead, said means to press, and said nip rolls are mounted on said carrier.

25. A two-mode thermal printer having at least one mode which conserves transfer medium comprising:

a printhead for providing a pattern of heat for thermal printing of images, means to move said printhead relative to a print-receiving location while feeding a transfer medium past said printhead for printing from said transfer medium from areas heated by said printhead, said means to move having a first mode in which said printhead and said transfer medium are moved at least substantially near the same velocity and a second mode in which said printhead is moved with at least twice the velocity of said transfer medium relative to the printhead to conserve said transfer medium by feeding said transfer medium at a velocity significantly less than the velocity of printhead movement, and externally controlled selection means to select either said first mode or said second mode.

26. The two-mode thermal printer as in claim 25 in which said first mode has printhead to transfer medium movement velocity ration in the range of 1.02 to 1 to 1.04 to 1 to also conserve said transfer medium by feeding said transfer medium at a velocity significantly less than the velocity of printhead movement.

27. The two-mode thermal printer as in claim 25 in which said second mode has a printhead to transfer medium movement velocity ratio in the range of 5 to 1 to 20 to 1.

28. The two-mode thermal printer as in claim 26 in which said second mode has a printhead to transfer medium movement velocity ratio in the range of 5 to 1 to 20 to 1.

29. The two-mode thermal printer as in claim 26 in which said first mode has a ratio of substantially 1.04 to 1.

30. The two-mode thermal printer as in claim 27 in which said first mode has a ratio of substantially 1.04 to 1.

31. The two-mode thermal printer as in claim 30 in which said second mode has a ratio of substantially 5 to 1.

32. The two-mode thermal printer as in claim 25 in which said printhead will provide electric current to a resistive layer of said transfer medium to provide said pattern of heat and said transfer medium is a thermal ribbon having said resistive layer and a layer, separated from said printhead by said resistive layer, of marking material rendered flowable by said pattern of heat in a pattern defined by said pattern of heat.

33. The two-mode thermal printer as in claim 26 in which said printhead will provide electric current to a resistive layer of said transfer medium to provide said pattern of heat and said transfer medium is a thermal ribbon having said resistive layer and a layer, separated from said printhead by said resistive layer, of marking material rendered flowable by said pattern of heat in a pattern defined by said pattern of heat.

34. The two-mode thermal printer as in claim 27 in which said printhead will provide electric current to a resistive layer of said transfer medium to provide said pattern of heat and said transfer medium is a thermal ribbon having said resistive layer and a layer, separated from said printhead by said resistive layer, of marking material rendered flowable by said pattern of heat in a pattern defined by said pattern of heat.

35. The two-mode thermal printer as in claim 28 in which said printhead will provide electric current to a resistive layer of said transfer medium to provide said pattern of heat and said transfer medium is a thermal ribbon having said resistive layer and a layer, separated from said printhead by said resistive layer, of marking material rendered flowable by said pattern of heat in a pattern defined by said pattern of heat.

36. The two-mode thermal printer as in claim 29 in which said printhead will provide electric current to a resistive layer of said transfer medium to provide said pattern of heat and said transfer medium is a thermal ribbon having said resistive layer and a layer, separated from said printhead by said resistive layer, of marking material rendered flowable by said pattern of heat in a pattern defined by said pattern of heat.

37. The two-mode thermal printer as in claim 30 in which said printhead will provide electric current to a resistive layer of said transfer medium to provide said pattern of heat and said transfer medium is a thermal ribbon having said resistive layer and a layer, separated from said printhead by said resistive layer, of marking material rendered flowable by said pattern of heat in a pattern defined by said pattern of heat.

38. The two-mode thermal printer as in claim 31 in which said printhead will provide electric current to a resistive layer of said transfer medium to provide said pattern of heat and said transfer medium is a thermal ribbon having said resistive layer and a layer, separated from said printhead by said resistive layer, of marking material rendered flowable by said pattern of heat in a pattern defined by said pattern of heat.

39. The two-mode thermal printer as in claim 25 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

40. The two-mode thermal printer as in claim 26 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

41. The two-mode thermal printer as in claim 27 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

42. The two-mode thermal printer as in claim 28 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

43. The two-mode thermal printer as in claim 29 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

44. The two-mode thermal printer as in claim 30 also comprising means to control the level of the heat of said pattern of heat to select a high level and to select a low level, said high level being for high-quality printing in said first mode, said low level being suited to adequate printing in said second mode, and means responsive to said externally controlled selection means to cause said means to control to select said high level during said first mode and said low level during said second mode.

45. The two-mode thermal printer as in claim 31 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

46. The two-mode thermal printer as in claim 32 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

47. The two-mode thermal printer as in claim 33 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

48. The two-mode thermal printer as in claim 34 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

49. The two-mode thermal printer as in claim 35 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

50. The two-mode thermal printer as in claim 36 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

51. The two-mode thermal printer as in claim 37 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

52. The two-mode thermal printer as in claim 38 also comprising means to control the level of the heat of said pattern of heat to select a high level and to select a low level, said high level being suited for high-quality printing in said first mode, said low level being suited to adequate printing in said second mode, and means responsive to said externally controlled selection means to cause said means to control to select said high level during said first mode and said low level during said second mode.

53. A two-mode thermal printer comprising:

a printhead having a line of elements for providing heat for thermal printing, means to move said printhead longitudinally while printing images by heat provided by said elements to a transfer medium, said longitudinal movement being directed to move said line of elements over an area corresponding to symbols to be printed, means to feed said transfer medium longitudinally past said printhead during said printing, selectable means having a first mode and a second mode, said first mode setting said means to move said printhead relative to said means to feed said transfer medium to a first status and said second mode setting said means to move said printhead relative to said means to feed said transfer medium to a second status, said first status being a velocity of said longitudinal movement of said printhead to velocity of said longitudinal feed of transfer medium ratio of near 1 to 1, said second status being a velocity of longitudinal movement of said print head to velocity of said longitudinal feed of transfer medium ratio of at least 2 to 1 to conserve said transfer medium by feeding said transfer medium at a velocity significantly less than the velocity of printhead movement, means to control the level of said heat to select a high level and to select a low level, said high level being suited for high-quality printing in said first mode, said low level being suited to adequate printing in said second mode, and selectable means to select either said first mode or said second mode and to cause said means to control to select said high level with said first mode and to select said low level with said second mode.

54. The two-mode thermal printer as in claim 53 in which said first status has a ratio in the range of 1.02 to 1 to 1.04 to 1 to also conserve said transfer medium by feeding said transfer medium at a velocity significantly less than the velocity of printhead movement.

55. The two-mode thermal printer as in claim 53 in which said second status has a ratio in the range of 5 to 1 to 20 to 1.

56. The two-mode thermal printer as in claim 54 in which said second status has a ratio in the range of 5 to 1 to 20 to 1.

57. The two-mode thermal printer as in claim 54 in which said first status has a ratio of substantially 1.04 to 1.

58. The two-mode thermal printer as in claim 55 in which said first status has a ratio of substantially 1.04 to 1.

59. The two-mode thermal printer as in claim 58 in which said second status has a ratio of substantially 5 to 1.

60. The two-mode thermal printer as in claim 53 in which said printhead will provide electric current to a resistive layer of said transfer medium to provide said heat and said means to feed said tranfer medium will feed a thermal ribbon having said resistive layer and a layer, separated from said printhead by said resistive layer, of marking material rendered flowable by said heat.

61. The two-mode thermal printer as in claim 54 in which said printhead will provide electric current to a resistive layer of said transfer medium to provide said heat and said means to feed said tranfer medium will feed a transfer medium having said resistive layer and a layer, separated from said printhead by said resistive layer, of marking material rendered flowable by said heat.

62. The two-mode thermal printer as in claim 55 in which said printhead will provide electric current to a resistive layer of said transfer medium to provide said heat and said means to feed said tranfer medium will feed a transfer medium having said resistive layer and a layer, separated from said printhead by said resistive layer, of marking material rendered flowable by said heat.

63. The two-mode thermal printer as in claim 56 in which said printhead will provide electric current to a resistive layer of said transfer medium to provide said heat and said means to feed said transfer medium will feed a thermal ribbon having said resistive layer and a layer, separated from said printhead by said resistive layer, of marking material rendered flowable by said heat.

64. The two-mode thermal printer as in claim 57 in which said printhead will provide electric current to a resistive layer of said transfer medium to provide said heat and said means to feed said transfer medium will feed a thermal ribbon having said resistive layer and a layer, separated from said printhead by said resistive layer, of marking material rendered flowable by said heat.

65. The two-mode thermal printer as in claim 58 in which said printhead will provide electric current to a resistive layer of said transfer medium to provide said heat and said means to feed said transfer medium will feed a thermal ribbon having said resistive layer and a layer separated from said printhead by said resistive layer, of marking material rendered flowable by said heat.

66. The two-mode thermal printer as in claim 59 in which said printhead will provide electric current to a resistive layer of said transfer medium to provide said heat and said means to feed said transfer medium will feed a thermal ribbon having said resistive layer and a layer, separated from said printhead by said resistive layer, of marking material rendered flowable by said heat.

67. A transfer-medium-conserving process of printing from a thermal transfer medium from which marking material flows after being softened by heat with a printhead which provides heat in a pattern comprising the steps of, moving said printhead to different printing locations while in heat-applying relationship to said transfer medium, and underfeeding said transfer medium relative to the movement of said printhead at least about one-fifth said relative movement of said printhead so that said pattern is applied to said transfer medium over an area less than the area of said pattern to conserve said transfer medium by feeding said transfer medium in an amount significantly less than the amount of printhead movement.

68. The process as in claim 67 in which the ratio of said underfeed is the range of 5 to 1 to 20 to 1.

69. The process as in claim 68 in which said ratio is substantially 5 to 1.

70. A transfer-medium-conserving process for producing an adequate draft copy and then a high-quality final copy based on said draft copy from a thermal transfer medium from which marking material flows after being softened by heat with a printhead which provides heat in a pattern comprising the steps of, printing a draft copy by moving said printhead to different printing locations while in heat-applying relationship to said transfer medium while conserving said transfer medium by underfeeding said transfer medium relative to the movement of said printhead in an amount significantly less than the amount of printhead movement so that said pattern is applied to said transfer medium over an area less than the area of said pattern, the ratio of said underfeed while typing said draft copy being at least 2 to 1, and then printing a high-quality final copy based on said draft copy by moving said printhead to different printing locations while in heat-applying relationship to said transfer medium while feeding said transfer medium near the same velocity as said printhead so that said pattern is applied to said transfer medium over an area nearly equal to the area of said pattern.

71. The process as in claim 70 in which said high-quality final copy is printed while underfeeding said transfer medium in a ratio in the range of 1.02 to 1 to 1.04 to 1 to also conserve said transfer medium by feeding said transfer medium in an amount significantly less than the amount of printhead movement.

72. The process as in claim 70 in which said draft copy is printed while underfeeding said transfer medium in a ratio in the range of 5 to 1 to 20 to 1.

73. The process as in claim 71 in which said draft copy is printed while underfeeding said transfer medium in a ratio in the range of 5 to 1 to 20 to 1.

74. The process as in claim 71 in which said high-quality final copy is printed while underfeeding said transfer medium in a ratio of substantially 1.04 to 1.

75. The process as in claim 72 in which said high-quality final copy is printed while underfeeding said transfer medium in a ratio of substantially 1.04 to 1.

76. The process as in claim 75 in which said draft copy is printed while underfeeding said transfer medium in a ratio of substantially 5 to 1.

77. A transfer-medium-conserving thermal printer comprising:

a printhead for providing a pattern of heat for thermal printing of images, means to move said printhead relative to a print-receiving location, and means to feed a transfer medium past said printhead for printing from said transfer medium from areas heated by said printhead, said means to move said printhead being for moving said printhead an amount which is in a ratio in the range of about 1.02 to 1 to 1.04 to 1 with respect to the amount of feed by said means to feed a transfer medium to conserve a transfer medium being fed by feeding said transfer medium in an amount significantly less than the amount of printhead movement.

78. The thermal printer as in claim 77 in which said ratio is about 1.04 to 1.

79. The thermal printer as in claim 77 in which said printhead will provide electric current to a resistive layer of said transfer medium to provide said pattern of heat and said means to feed a transfer medium will feed a transfer medium having said resistive layer and a layer, separated from said printhead by said resistive layer, of marking material rendered flowable by said pattern of heat in a pattern defined by said pattern of heat.

80. The thermal printer as in claim 78 in which said printhead will provide electric current to a resistive layer of said transfer medium to provide said pattern of heat and said means to feed a transfer medium will feed a transfer medium having said resistive layer and a layer, separated from said printhead by said resistive layer, of marking material rendered flowable by said pattern of heat in a pattern defined by said pattern of heat.

81. A transfer-medium-conserving thermal printer comprising:

a printhead having a line of elements for providing heat for thermal printing, means to move said printhead longitudinally while printing images by heat provided by said elements to a transfer medium, said longitudinal movement being directed to move said line of elements over an area corresponding to symbols to be printed, and means to feed said transfer medium longitudinally past said printhead during said printing, said means to move said printhead being for moving said printhead an amount which is in a ratio in the range of about 1.02 to 1 to 1.04 to 1 with respect to the amount of feed by said means to feed said transfer medium to conserve said transfer medium by feeding said transfer medium in an amount significantly less than the amount of printhead movement.

82. The thermal printer as in claim 81 in which said ratio is about 1.04 to 1.

83. The thermal printer as in claim 81 in which said printhead will provide electric current to a resistive layer of said transfer medium to provide said pattern of heat and said means to feed a transfer medium will feed a transfer medium having said resistive layer and a layer, separated from said printhead by said resistive layer, of marking material rendered flowable by said pattern of heat in a pattern defined by said pattern of heat.

84. The thermal printer as in claim 82 in which said printhead will provide electric current to a resistive layer of said transfer medium to provide said pattern of heat and said means to feed a transfer medium will feed a transfer medium having said resistive layer and a layer, separated from said printhead by said resistive layer, of marking material rendered flowable by said pattern of heat in a pattern defined by said pattern of heat.

85. A transfer-medium-conserving thermal printer comprising:

a printhead for providing a pattern of heat for thermal printing of images, a transfer medium having a supporting substrate carrying a marking material flowable to print symbols in patterns defined by heat from said substrate, means to mount print-receiving medium adjacent said marking material, means to press said printhead into said transfer medium and said transfer medium into said print-receiving medium, means to move said printhead across said print-receiving medium during printing from said transfer medium with heat provided by said printhead, and means to feed unused transfer medium to said printhead during said printing at a velocity relative to the printhead in the range of about 1 to 1.02 to 1 to 1.04 of the velocity of movement of said printhead relative to the print-receiving medium to conserve said transfer medium by feeding said transfer medium at a velocity significantly less than the velocity of printhead movement, said means to press and said marking material being selected so as not to smear on said print-receiving medium from rubbing on said print-receiving medium during said feeding of said transfer medium.

86. The thermal printer as in claim 85 in which said ratio is about 1 to 1.04.

87. The thermal printer as in claim 85 comprising nip rolls to pull said transfer medium across said printhead as part of said means to feed unused transfer medium and in which said means to move said printhead comprises a carrier for moving across said print-receiving medium, and said printhead, said means to press, and said nip rolls are mounted on said carrier.

88. The thermal printer as in claim 86 comprising nip rolls to pull said transfer medium across said printhead as part of said means to feed unused transfer medium and in which said means to move said printhead comprises a carrier for moving across said print-receiving medium, and said printhead, said means to press, and said nip rolls are mounted on said carrier.

89. A transfer-medium-conserving process of printing from a thermal transfer medium from which marking material flows after being softened by heat with a printhead which provides heat in a pattern comprising the steps of, moving said printhead to different printing locations while in heat-applying relationship to said transfer medium, and underfeeding said transfer medium relative to the movement of said printhead in a range of about 1.02 to 1 to 1.04 to 1 of said relative movement of said printhead so that said pattern is applied to said transfer medium over an area less than the area of said pattern to conserve said transfer medium by feeding said transfer medium in an amount significantly less than the amount of printhead movement.

90. The process as in claim 89 in which said ratio is about 1.04 to 1.

* * * * *